United States Patent [19]

Keeton

[11] Patent Number: 4,750,442

[45] Date of Patent: Jun. 14, 1988

[54] CUFF PRODUCTION

[76] Inventor: John H. Keeton, P.O. Box 296, Campbellsville, Ky. 42718

[21] Appl. No.: 889,282

[22] Filed: Jul. 23, 1986

Related U.S. Application Data

[63] Continuation of Ser. No. 560,579, Dec. 12, 1983, abandoned.

[51] Int. Cl.[4] ..... D05B 1/00; D05B 37/04; D05B 27/00; B26D 1/03

[52] U.S. Cl. ..... 112/262.1; 112/121.26; 112/130; 112/304; 112/305; 112/312; 112/319; 112/DIG. 2; 83/156; 271/3.1

[58] Field of Search ..... 112/262.1, 262.2, 262.3, 112/129, 130, 254, 304, 305, 312, 319, 121.11, 121.12, 121.15, 121.16, 121.26, 121.27, DIG. 2, DIG. 3; 226/186, 190–193; 271/65–69, 90, 91, 97, 306–311, 3.1; 29/110, 124, 121.6; 83/145, 156

[56] References Cited

U.S. PATENT DOCUMENTS

| | | | |
|---|---|---|---|
| 2,940,404 | 6/1960 | Damon | 112/121.15 |
| 3,126,848 | 3/1964 | Gastonguay | 271/69 |
| 3,130,844 | 4/1964 | Robinson et al. | 112/304 |
| 3,345,965 | 10/1967 | Gore | 112/121.15 |
| 3,485,490 | 12/1969 | Ramsey et al. | 112/121.29 |
| 3,544,102 | 12/1970 | Hughes | 112/121.15 |
| 3,722,435 | 3/1973 | Elsas | 112/130 |
| 3,773,002 | 11/1973 | Burton | 112/130 |
| 3,808,993 | 5/1974 | Heiler et al. | 112/121.29 |
| 3,906,878 | 9/1975 | Burton | 112/262 |
| 3,933,105 | 1/1976 | Frost et al. | 112/121.29 |
| 3,970,021 | 7/1976 | Meadows et al. | 112/262.3 |
| 4,132,184 | 1/1979 | Burton | 112/262.1 |
| 4,149,484 | 4/1979 | Koch | 83/156 |
| 4,154,180 | 5/1979 | Burton | 112/262.3 |
| 4,290,376 | 9/1981 | Brusasca et al. | 112/305 |
| 4,524,706 | 6/1985 | Bell | 112/130 |

FOREIGN PATENT DOCUMENTS

| | | | |
|---|---|---|---|
| 2032838 | 11/1970 | France | 112/121.29 |
| 0024855 | 3/1978 | Japan | 226/190 |
| 1021888 | 3/1966 | United Kingdom | 112/121.29 |

OTHER PUBLICATIONS

Cutter Exchange Catalog; Stacker Model #25696–S, p. 143; date: 1968.

Russian Document #0663652; May 1979; 2 pp. Spec. 1 Drawing.

*Primary Examiner*—Harvey C. Hornsby
*Assistant Examiner*—Joseph S. Machuga
*Attorney, Agent, or Firm*—Cushman, Darby & Cushman

[57] ABSTRACT

A method and apparatus provided for the automatic production of discrete cuffed sleeve blanks from distinct initial sleeve blanks and a continuous roll of knit cuffing material. The initial sleeve blanks are place end-to-end, a gap is introduced between them, and they are passed in a first direction with a first edge thereof parallel to the first direction. The continuous length of cuffing material is folded over to provide a double thickness having a first edge which is parallel to the sleeve blank first edge, the cuffing material and sleeve blank first edges are overlapped, moved together, and sewn to each other with an "over-edger" automatic sewing machine. The cuffing material is stretched just prior to being fed to the sewing machine, and is stretched again after sewing and severed from the rest of the roll. A driven roller includes non-rotatable washers having projecting portions engaging a blade of the cutting mechanism. The sleeve blanks formed are automatically picked up and moved in a second direction perpendicular to the first direction. For long sleeve finished blanks this is accomplished by utilizing a pair of projecting portions relatively rotatable with respect to each other to grasp the cuff of the finished blank betwen them, one of the projections having an air jet associated with it.

14 Claims, 7 Drawing Sheets

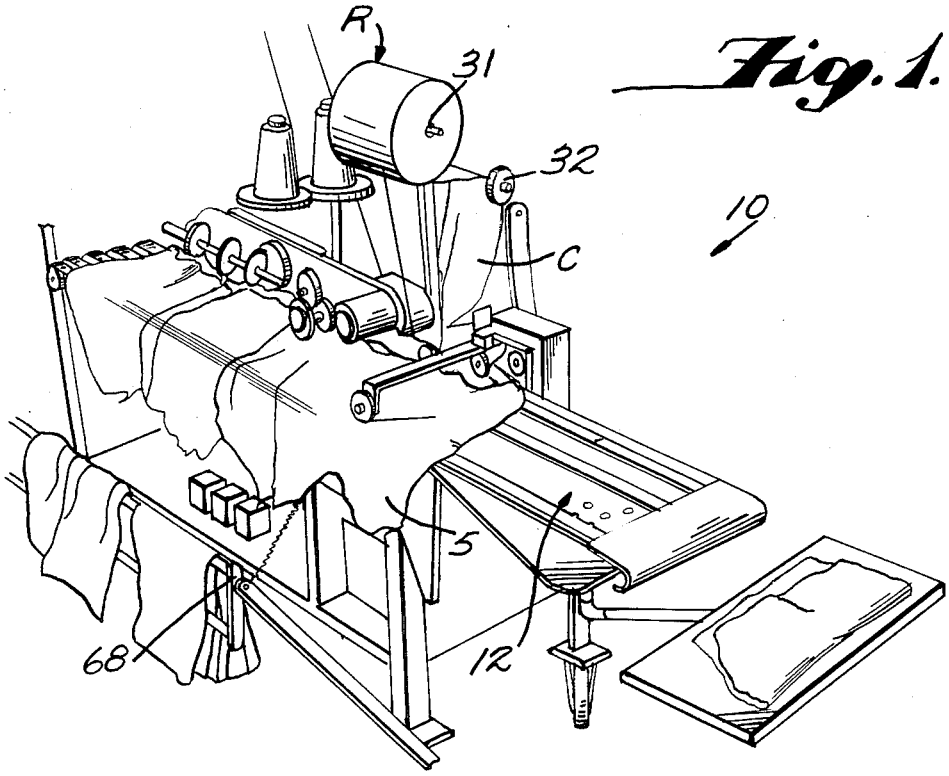
Fig. 1.
Fig. 2.
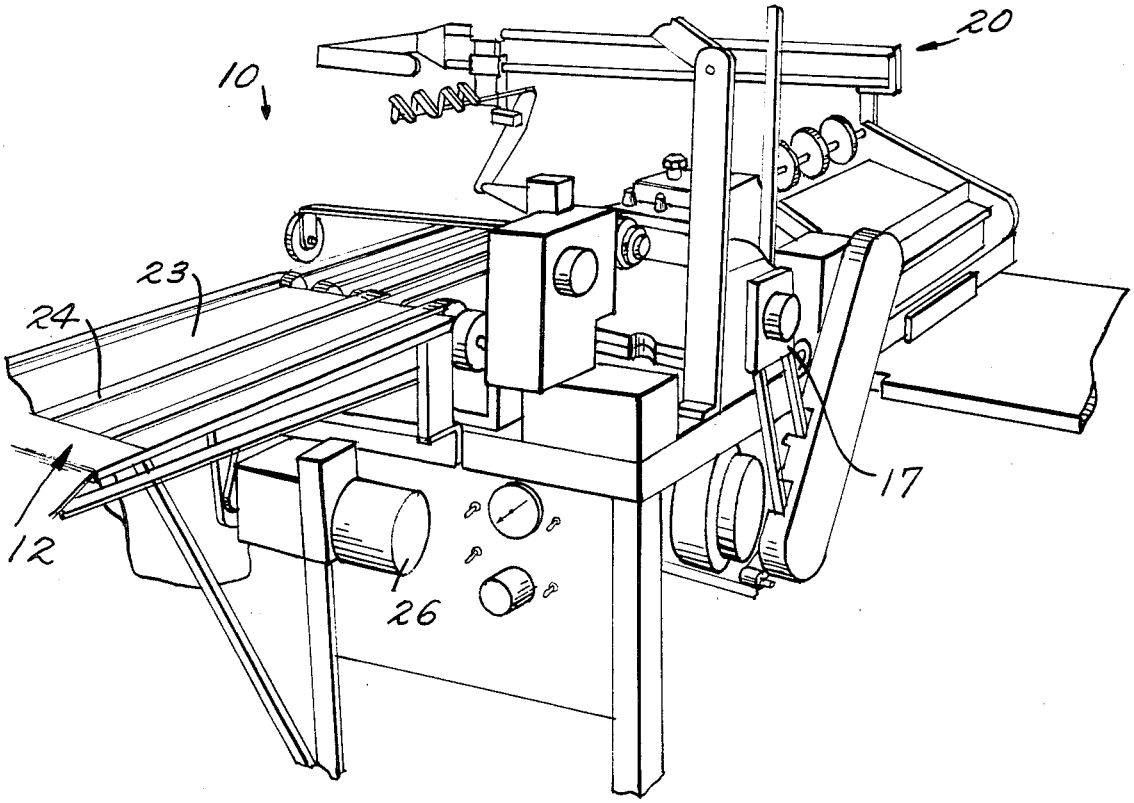

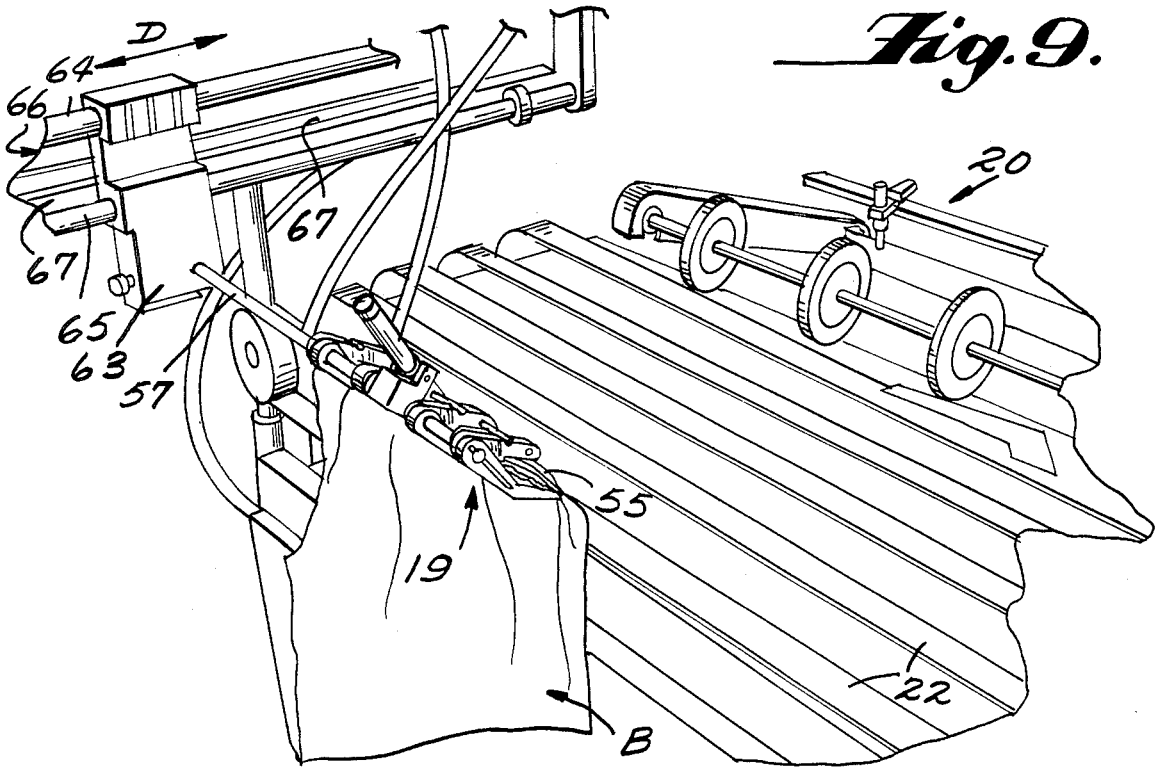
Fig. 9.
Fig. 10.
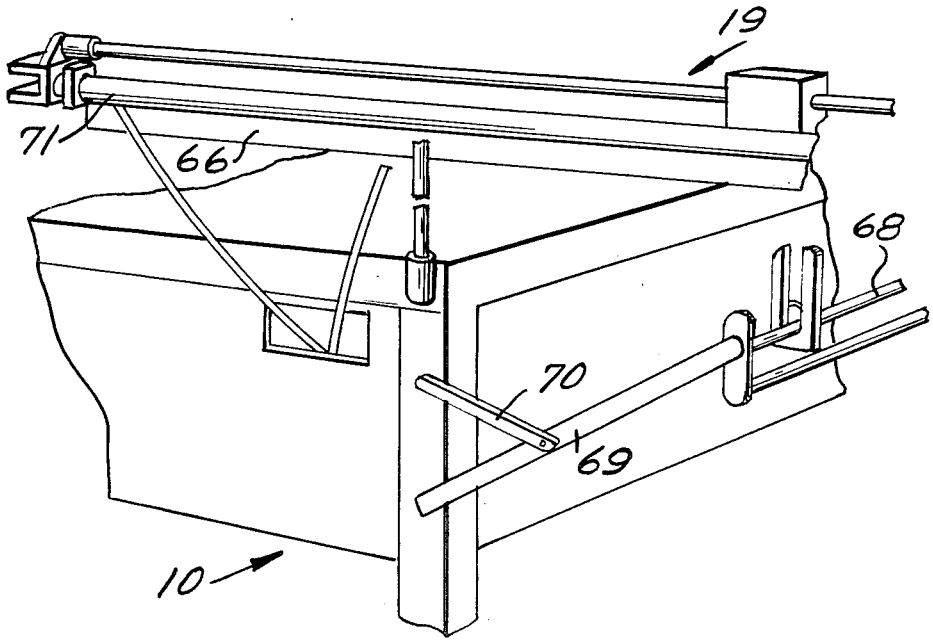

CUFF PRODUCTION

This is a continuation of application Ser. No. 560,579, filed Dec. 12, 1983, which was abandoned upon the filing hereof.

BACKGROUND AND SUMMARY OF THE INVENTION

In the production of sportswear, such as sweatshirts, jogging suits, and the like, one of the key operations is the cuffing of the sleeves. This is usually a laborious and time consuming procedure, and one that is highly desirable to automate. In the past, however, there has not been an emminently successful way to automate this procedure.

According to the present invention, an emminently practical and simple method and apparatus are provided for the automation of the procedure for cuffing sportswear, such as sweatshirts, jogging outfits, and the like. According to the present invention not only are cuffed sleeves and the like produced automatically, but they are stacked in a manner that facilitates the subsequent use thereof in other production procedures (primarily for the sewing of the sleeves together to form the final garment arm).

According to the method of the present invention, the automatic cuffing of sportswear sleeves or the like is provided by practicing the following steps: (a) Passing a sleeve blank in a first direction, the blank having a first edge generally parallel to the first direction. (b) Doubling over a continuous length of cuffing material to form a double thickness edge of cuff material. (c) Feeding the doubled over cuffing material so that it overlaps the sleeve blank with the double thickness edge of the duff material generally parallel to and in alignment with the first edge of the sleeve blank. (d) Automatically sewing (with an over-edger automatic sewing machine) the sleeve blank to the cuffing material along the first and double thickness edges thereof, respectively. (e) Automatically severing the cuff material to form a distinct, discrete cuffed sleeve blank; and (f) moving the cuffed sleeve blank to a stacking position.

The final sleeve blank produced is moved to a stacking position in a direction generally perpendicular to the first direction. If the sleeve is a long sleeve, a pick up head with associated air jet grasps the cuff of the final blank, moves horizontally in the second direction, and drapes the blank over a rail. If the blank is a short sleeve blank, a flipping mechanism is rotated into position so that gripping rollers thereof grab the final blank, move it to the flipper, and then the flipper flips the blank onto a stack on a table.

The sleeve blanks are normally aligned end to end, and then a small gap is introduced between them prior to movement into operative association with the automatic sewing machine. Additionally, the roller mechanisms which provide for feeding of the cuffing material introduce a stretch into the cuffing material—which has knit construction—and after sewing the cuff is further stretched in order to facilitate the severing of the cuff of the final cuffed sleeve blank from the continuous roll of cuffing material.

The apparatus according to the present invention includes a first conveyor surface having a plurality of conveyor belts including portions thereof disposed over the first surface. The conveyor belts are elongated in a first direction—the direction of travel of garment blanks conveyed thereby. The belts are spaced from each other in a second direction, generally perpendicular to the first direction. A continuous roll of cuffing material is provided, and is in operative association with a cuff folding mechanism. First, second, and third conveying rollers are provided mounted above and in operative association with the first conveying surface and the conveyor belts disposed thereon. A scissors-like cutting device is provided after the second roller, and an over-edger automatic sewing machine is provided between the first and second rollers. After the third roller, a pick-up mechanism is provided, one or both of the pick-up mechanisms described above being preferred.

A second conveyor surface having a plurality of conveyor belts associated therewith is also provided upstream of the first conveyor surface. The conveyor belts of the second conveyor system are interleaved with the belts of the first system. The belts of the second system run continuously, while those of the first system operate intermittently.

Also according to the present invention the pick-up head for removing the finished cuffed sleeve blanks from the first conveying surface is unique. The head includes first and second projecting portions which are relatively pivotal with respect to each other to move from a position wherein they grasp the cuff of the finished blank therebetween to a position wherein they release the cuff. One of the projections has an air jet associated therewith for directing a stream of air to separate the cuff from the sleeve to facilitate grasping of the cuff. The air jet moves the cuff up against an apertured guard mechanism, the upper projections of the head aligned with the apertures in the guard mechanism. A cable cylinder arrangement reciprocates the pick-up head in a second direction, perpendicular to the first direction, to drape the finished blanks over a rail.

Also according to the present invention, a particular roller mechanism is provided which prevents cuff material from moving in front of the cutter blades prior to severing of the material. The roller mechanism includes a central rotating shaft to which a plurality of axially spaced rubber rings are connected. Metal washers separate the rubber rings, and at least some of the washers are loose on the shaft (that is they do not rotate with the shaft). The great majority of the circumference of the separating washers has a smaller radial extent than the rubber rings, however a portion of each of at least some of the washers projects outwardly past the circumferential periphery of the rubber rings, and engages one of the blades of the cutting mechanism to prevent garment material from moving between the roller and the blade.

It is the primary object of the present invention to effect the simple and reliable automatic cuffing of sportswear sleeves or the like. This and other objects of the invention will become clear from an inspection of the detailed description of the invention, and from the appended claims.

BRIEF DESCRIPTION OF THE DRAWINGS

FIG. 1 is a front perspective view of an exemplary automatic cuffing machine according to the invention, showing garment blanks associated therewith;

FIG. 2 is a rear perspective view of the machine of FIG. 1 with no garment blanks associated therewith;

FIG. 9 is a top perspective view of the pick-up head of FIGS. 7 and 8 showing it transporting a finished sleeve blank away from the conveying surface, and about to drape it over a rail;

FIG. 10 is a detail perspective view of the rail mounting mechanism associated with the long sleeve stacker of FIGS. 7–9;

DETAILED DESCRIPTION OF THE DRAWINGS

Figure 12:
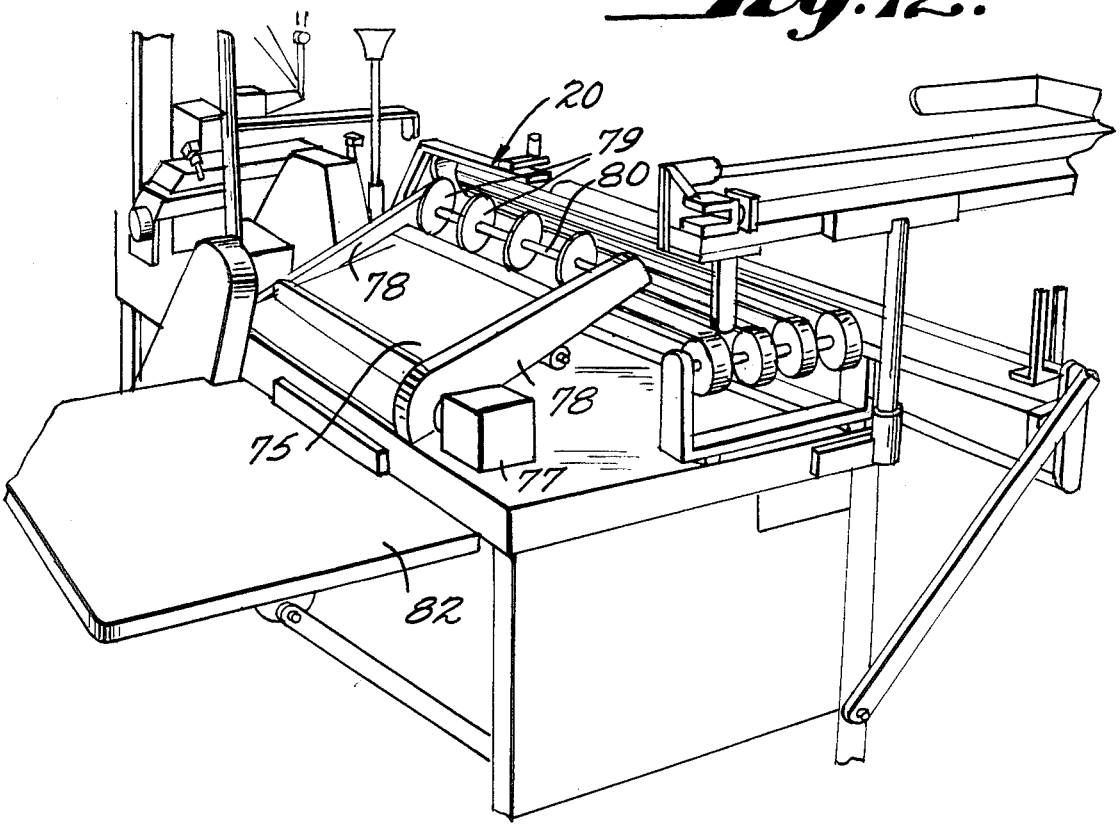
FIG. 12 is a side and top perspective view of an exemplary short sleeve stacker according to the present invention.
Figure 13:
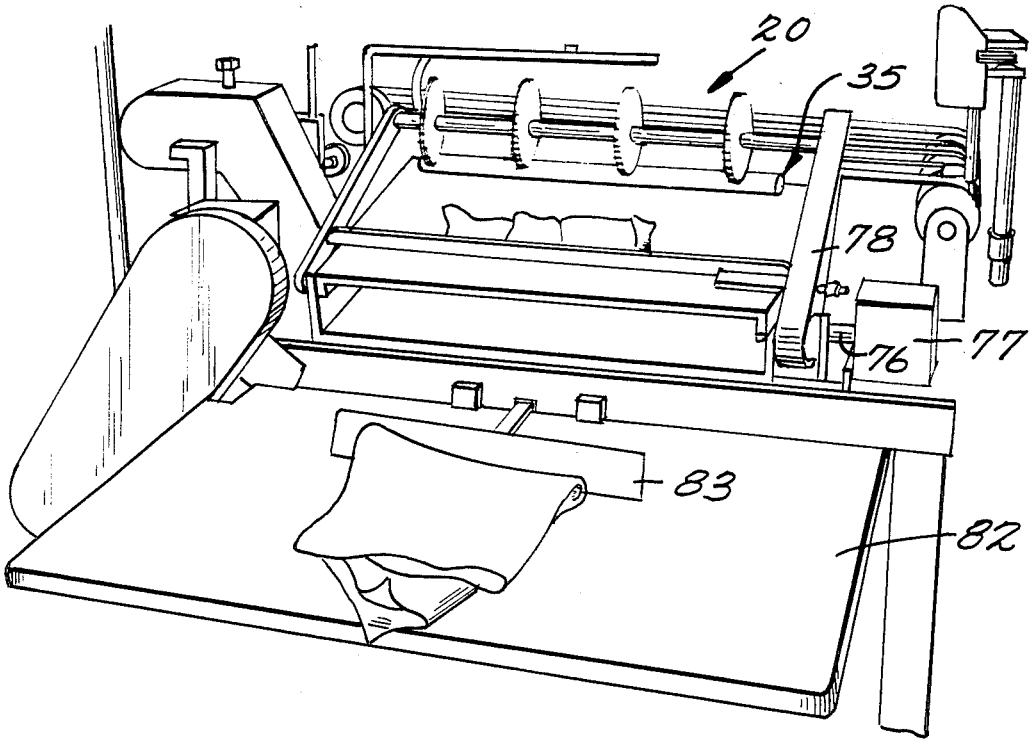
FIG. 13 is a view similar to that of FIG. 12 and showing a stack mover associated with the table of the short sleeve stacker.

An exemplary machine according to the present invention is shown generally by reference numeral 10 in the drawings. The major components of the machine 10 comprise a first conveying mechanism 11, a second conveying mechanism 12, a supply system 13 for knit cuffing material, a feed and stretching system for the cuffing material comprising first, second, and third rollers 14, 15, and 16, respectively; an automatic sewing machine 17; a cuffing material severing mechanism 18 (see FIG. 6); a long sleeve finished blank pick-up means 19 (see FIGS. 7–10); and a short sleeve finished blank pick-up mechanism 20 (see FIGS. 12 and 13).

Figure 3:
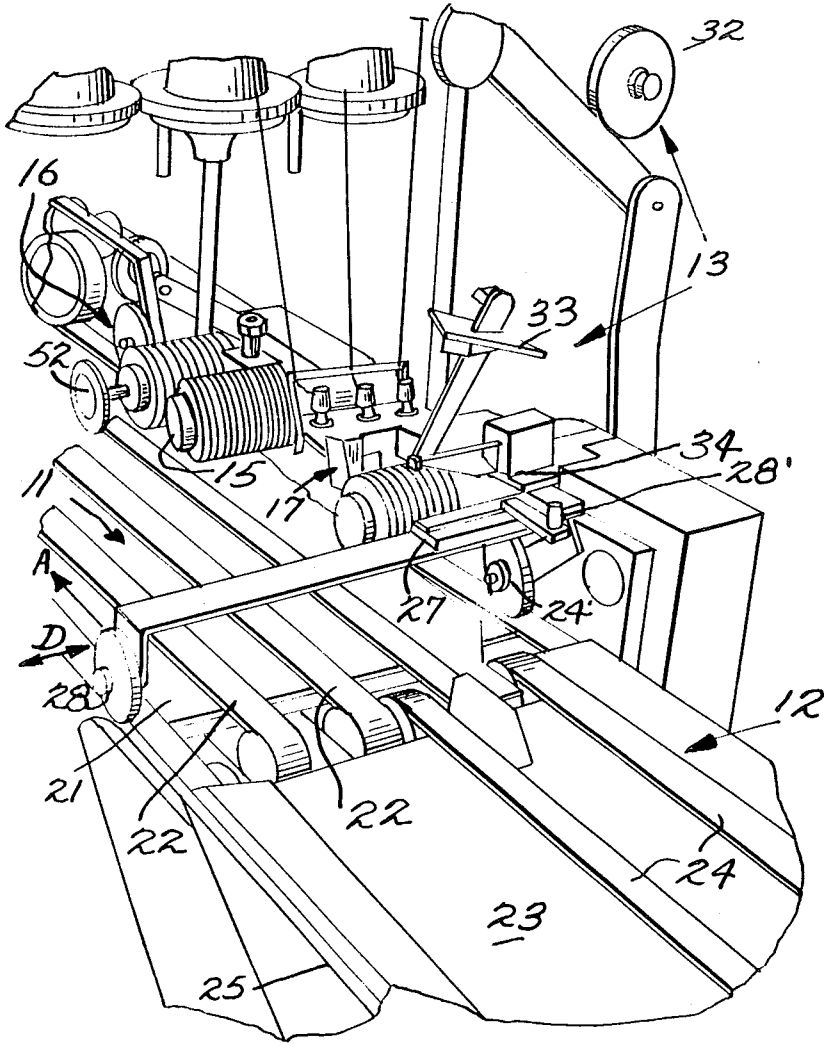
FIG. 3 is a top perspective detailed view showing the area between the first and second conveying systems of the machine of FIG. 1, and with the cuffing material removed so that the cuffing material folding mechanism and the cuffing material transporting rollers are visible.

First conveying means 11 comprises a flat metal conveying surface 21 with a plurality of spaced elongated conveyor belts 22 associated therewith, and having portions extending thereover, as illustrated most clearly in FIG. 3. The belts 22 are elongated in a first direction A, which is the direction of transport of garments thereby. The belts 22 are spaced in a second dimension D perpendicular to the first direction A. The belts 22 are operated intermittently to convey garment blanks therealong through the various operating stations in the dimension A.

Figure 4:
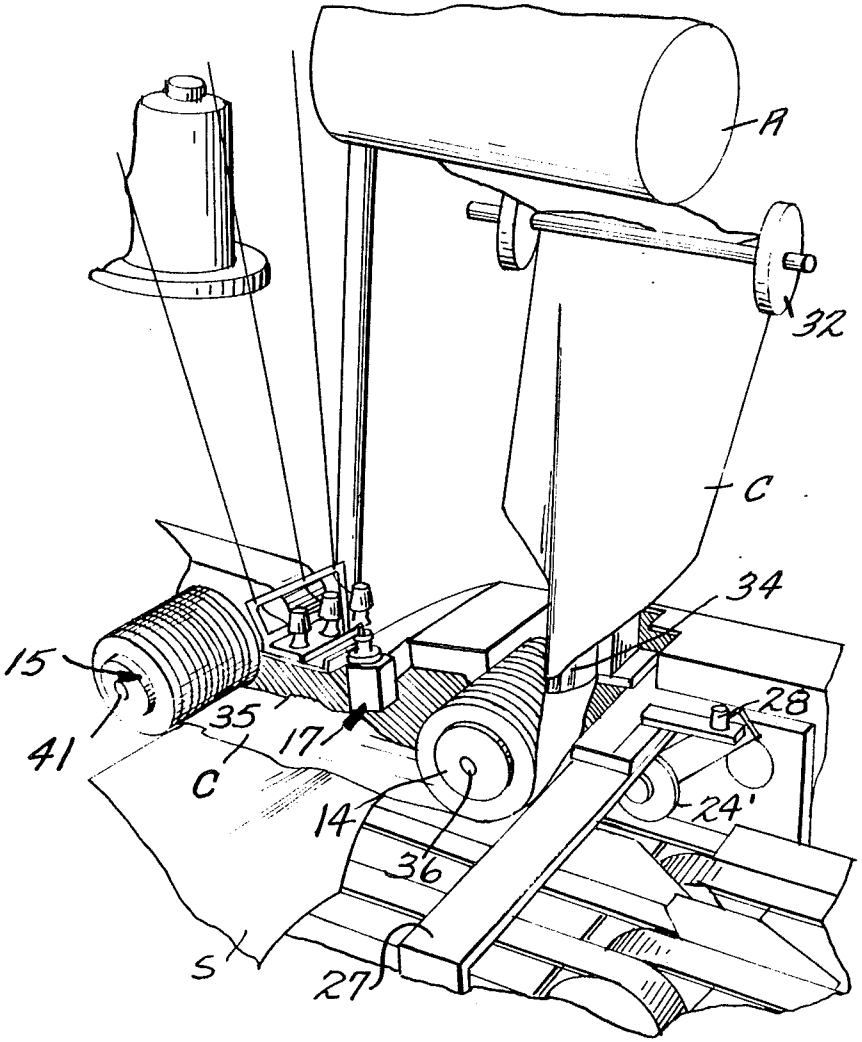
FIG. 4 is a detailed top perspective view similar to that of FIG. 3 only showing the cuffing material in operative association with various components of the machine.
Figure 14:
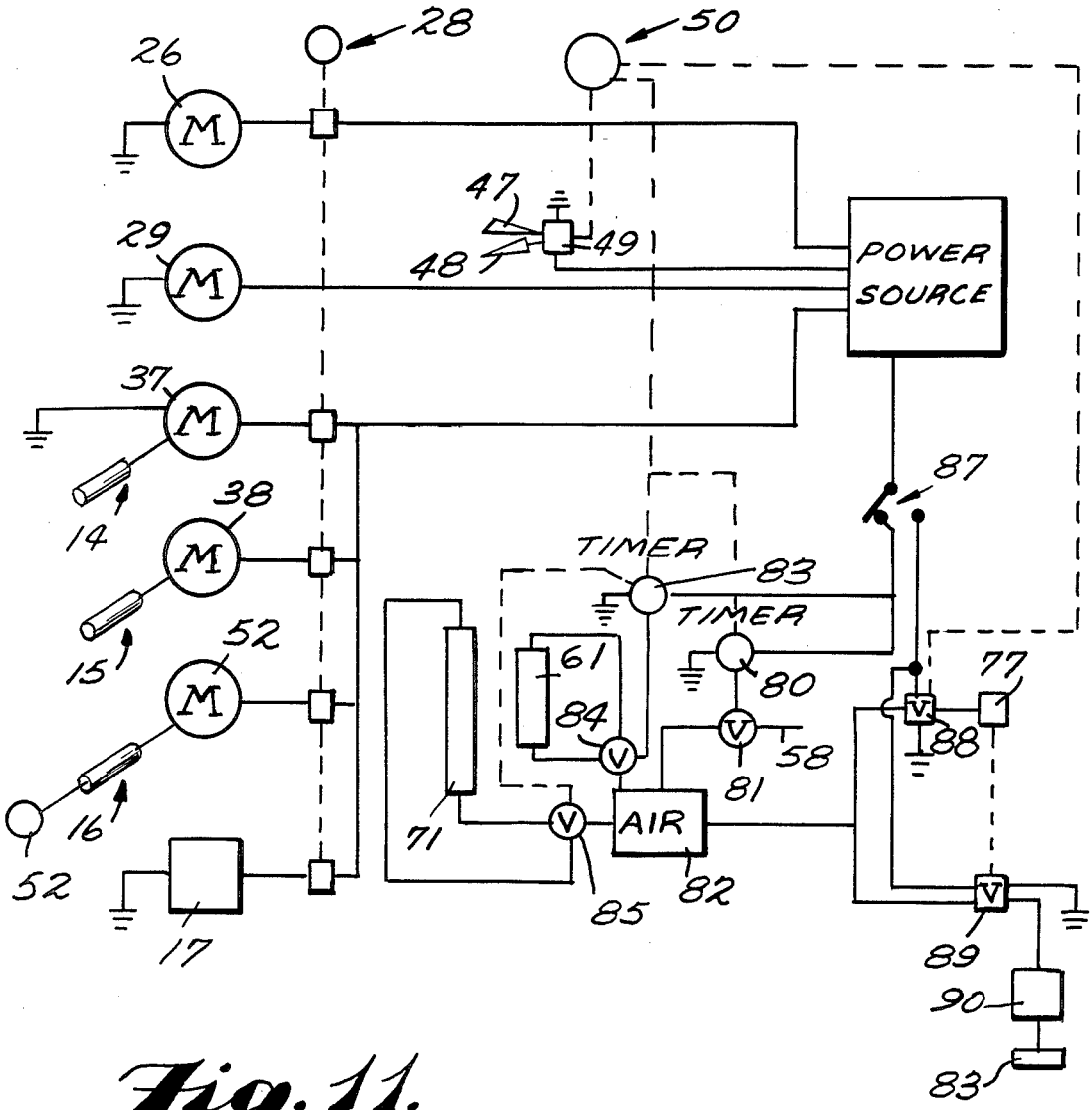
FIG. 14 is a control schematic for the machine of FIG. 1.

The second conveying mechanism 12 includes a second, flat, conveying surface 23. A plurality of conveyor belts 24 are also associated therewith, the conveyor belts 24 interleaved with the belts 22. Idle roller 24' (see FIGS. 3 and 4) helps hold the cloth blanks S on the belts 24. The drive belt 25 drives the belts 24 via a motor 26 (see FIG. 14) disposed under the surface 23. An arm 27 extending across the area between the conveying surfaces has a remote roller 28 which engages the drive belt 25 and ensures that it is held in place, and the arm 27 also mounts a sensing means, such as an electric eye 28'. The belts 24 are driven continuously by drive belt 25. The electric eye 28—as shown in FIG. 14—controls the motor 29 for driving the belts 22.

The cuffing material supply mechanism 13 includes an idler shaft 31 (see FIG. 1) which supports a roll R of knit cuffing material. Cuffing material extends over guide roller 32 (see FIGS. 3 and 4) to the doubling-over wedge-shaped mechanism 33, and then is threaded through the sleeve guide 34 and passes under a first roller 14. The manner in which doubling-over of the cuffing material C is accomplished is seen most clearly in FIG. 4. The doubled over material has a first, double thickness edge 35 associated therewith.

The first roller 14 is rotatable about a shaft 36 (see FIG. 4) which extends in the dimension D, and it is mounted so that it is just above the surface 21 and conveyor belts 22 and in operative association therewith. Roller 14 is driven by a motor 37 (see FIG. 14), and is driven at a differential speed with respect to the second roller 15, which is driven by motor 38 (see FIG. 14). Motor 38 is driven at the same speed as the conveyor belts 22, while motor 37 drives roller 14 at a slower speed so that the cuffing material C is stretched between the rollers 14 and 15.

Figure 6:
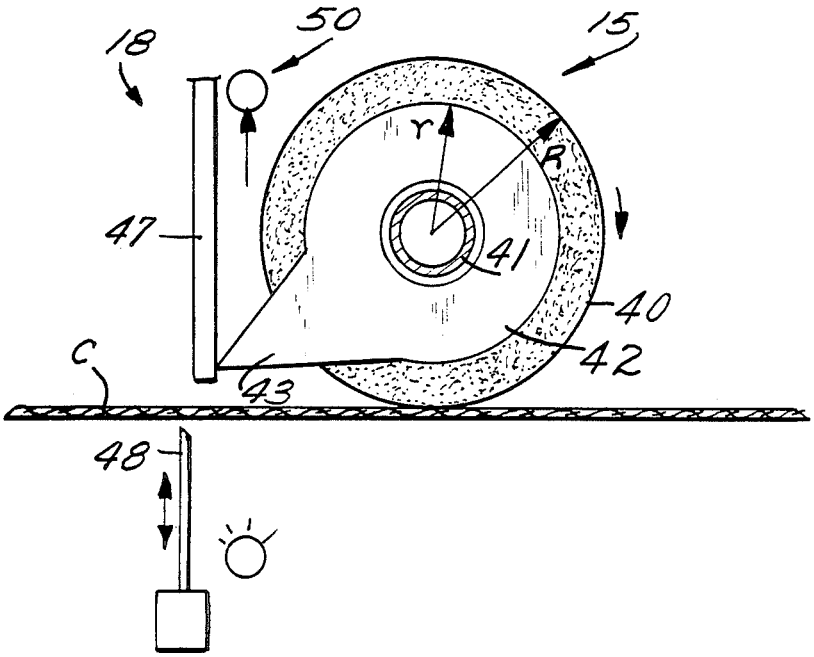
FIG. 6 is a schematic side view, partly in cross section and partly in elevation, showing the mechanism for preventing cuffing material from riding up between the second roller and knife blade.

The rollers 15 and 16, like roller 14, are mounted for rotation about axes that extend in dimension D. Additionally, all of the rollers are constructed so that they are formed by a plurality of axially spaced rubber rings 40 (see FIG. 6) which are mounted to the central shaft which effects rotation thereof. In FIG. 6, the roller 15 is illustrated, the central shaft 41 thereof attached to the rubber rings 40. Axially separating the rings 40 are plurality of metal washers 42. As illustrated in FIG. 6, the washers 42 are loosely mounted on the shaft 41, and do not rotate therewith.

For the rollers 14 and 16 the radius r of the washers 42 is less than the radius R of the rubber rings 40 throughout their entire extent. However, because of the special functions of the second roller 15, at least a plurality of the washers 42 associated therewith have a projection 43 which extend outwardly past the circumferential periphery of the rubber rings 40, and into operative association with the cutting means 18, as will be hereinafter explained.

Figure 11:
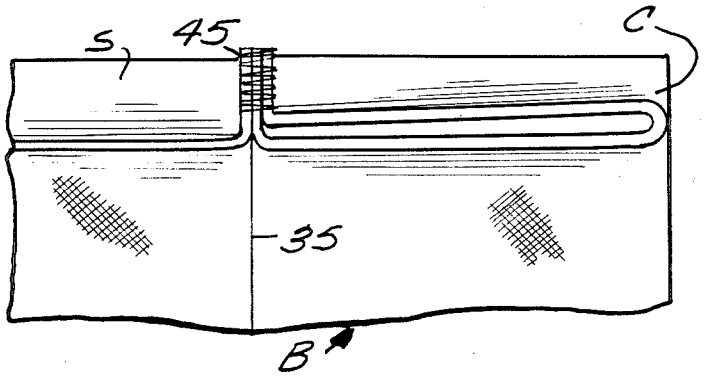
FIG. 11 is a side view of a finished cuffed sleeve blank according to the invention, with a portion of the sleeve blank turned up for clarity of illustration.

Disposed between the rollers 14 and 15 is an automatic sewing machine 17. The sewing machine is preferably an over-edger automatic sewing machine which effects trimming of the edges of the garments fed thereto at the same time that it stitches the garments together. The sewing machine 17 stitches cuffing material C along the edge 35 thereof to a first edge 45 (see FIG. 11) of a sleeve blank S, to provide a seam having a double thickness of cuff sewn to a single thickness of the sleeve blank, as illustrated in FIG. 11.

Between the rollers 15 and 16 is the cutting mechanism 18. Cutting mechanism 18 preferably comprises first and second blades 47, 48, which are moved relative to each other to effect severing of cloth cuff material C moving therebetween. Blades 47, 48 preferably move in a scissors like manner, with the projections 43 of the washers 42 abutting the blade 47. The projection 43 keep the cuff material C from riding up between the roller 15 and the blade 47, and thus facilitate effective operation of the cutting mechanism 18.

A solenoid, or any other suitable type of mechanism, 49 for effecting relative movement between the blades 47, 48 is controlled by the second electric eye mechanism 50. The mechanism 50 is mounted so that a portion thereof is between the rollers 15, 16 at a position over the conveyor surface 21 at which cuffing material C will never extend. The other part of the mechanism 50 is disposed below the conveyor surface 21, within an aperture formed in the conveyor surface at that position.

Figure 5:
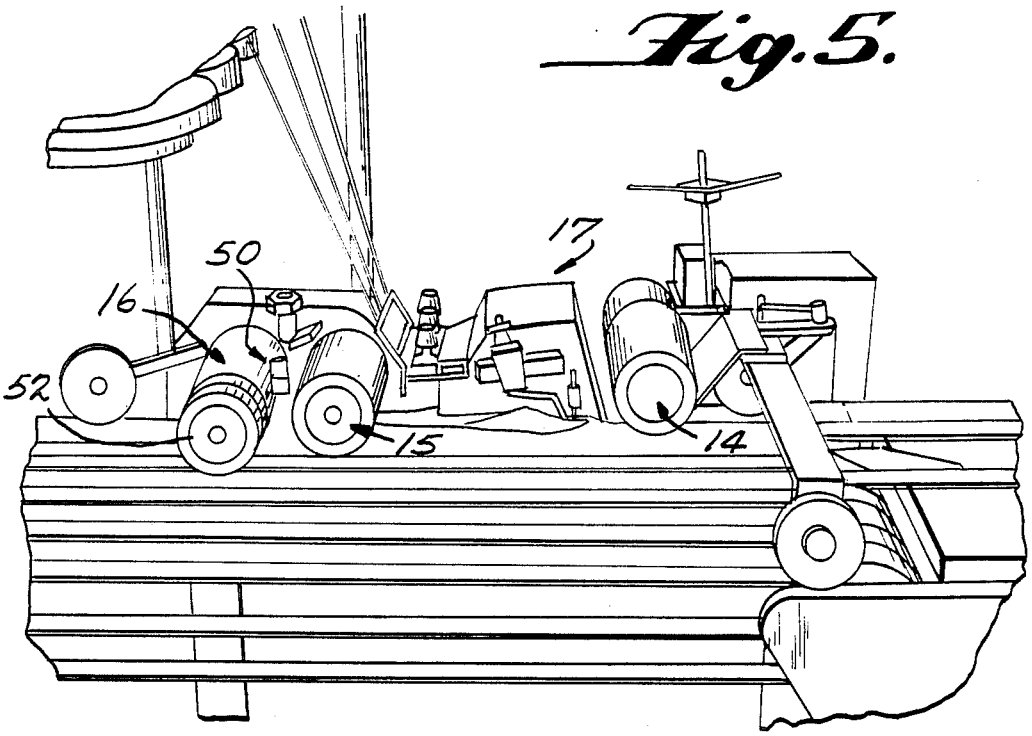
FIG. 5 is a side perspective view of the cuffing material transporting rollers, and other components, of the machine of FIG. 1, with the cuffing material and sleeve blanks removed for clarity of illustration.

Third roller 16 is driven by a motor 52 (see FIG. 14), and is operated at a speed faster than the second roller 15. This differential in speed (e.g. the third roller 16 may be operated at about 30% faster than the second roller 15) again effects stretching of the cuffing material C, to facilitate cutting thereof by the cutting mechanism 18, and also facilitates introduction of a gap between finished sleeve blanks B. The third roller 16 also has an extension 52 (see FIGS. 3 and 5 in particular) which has a larger circumferential diameter than the rest of the roller 16. This extension 52 engages the body of the sleeve while the rest of the roller 16 is engaging a cuffed portion, and causes the body portion to speed up with respect to the cuff, and facilitates introduction of a gap between adjacent sleeve blanks.

Downstream of the third roller 16 are the pick-up mechanisms 19, 20. Both pick-up mechanisms are for moving the final cuffed sleeve blank B (see FIG. 9) formed in the dimension D, off of the conveyor belt 22. The pick-up mechanism 19 is illustrated most clearly in FIGS. 7-10, and is adapted to pick up and stack long sleeve finished blanks B.

Mechanism 19 includes a first plurality of projecting portions 54, and a second plurality of projecting portions 55. Portions 55 preferably are made of spring steel, and portions 54 are non-resilient and have an air jet 56 associated therewith. Portions 54, 55 are relatively rotatable with respect to each other about an axis defined by shaft 57, from a position wherein they are spaced from each other (see FIG. 7), to position wherein they are adjacent each other (see FIG. 9) and grasp the cuff portion C of a finished blank B therebetween.

Figure 7:
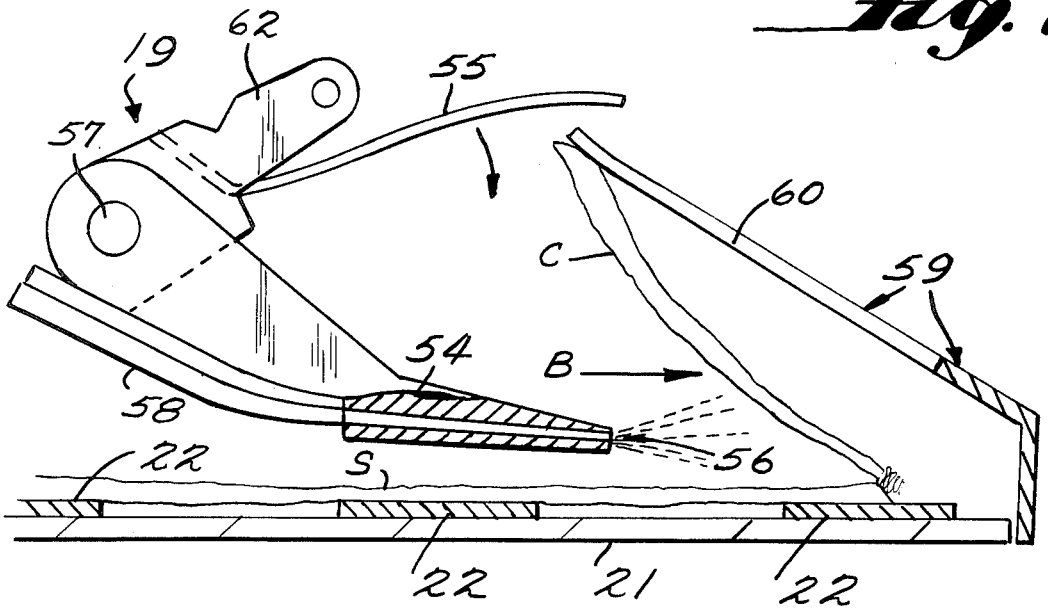
FIG. 7 is a side schematic view showing in detail components of a pick-up head according to the invention for picking up finished long sleeve cuffed blanks.
Figure 8:
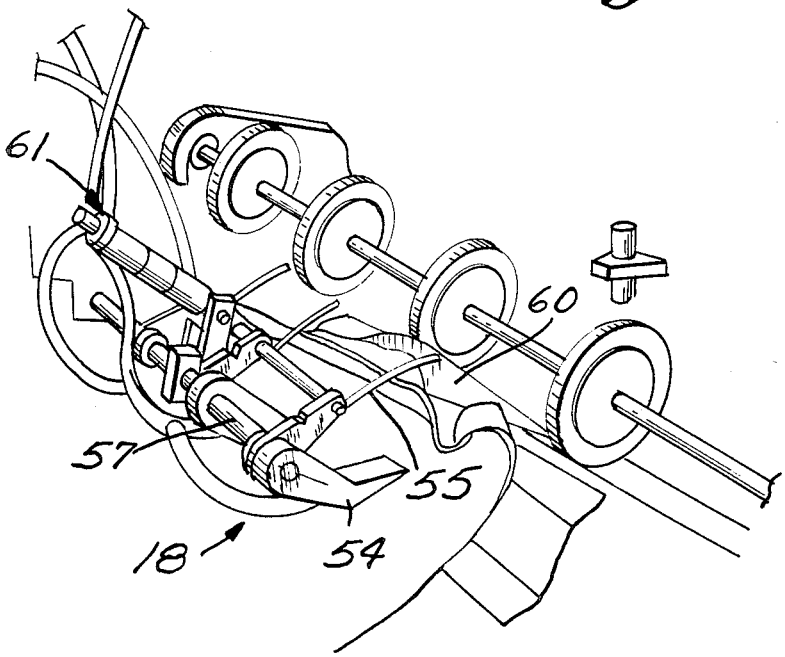
FIG. 8 is a top and side perspective view of the pick-up head of FIG. 7.

The air jet 56 associated with each projection 54 is provided with air through an air tube 58, the air being introduced between the cuff C and the sleeve S to effect movement of the cuff upwardly against an apertured guard 59, as illustrated in FIG. 7. As illustrated in FIG. 8, the projections 55 are aligned with the apertures 60 of the guard 59. Upon actuation of any suitable means for effecting relative rotation between the members 54, 55 [such as the pneumatic cylinder 61 which effects rotation of the projections 55, and the supports 62 to which they are connected, about the shaft 57], results in the projections 54, 55 grasping the cuff C of the blank B therebetween.

As seen most is clearly in FIGS. 9 and 10, once the blank B is grasped by the means 19, it is moved in the direction D by effecting linear movement of the block 63 to which the shaft 57 is connected. The block 63 is guided by guide rails 64, 65 mounted in the linearly extending support 66. The free ends of cables 67 from a conventional pneumatic cable cylinder 71 (FIG. 14) are connected to the block 63, and effect reciprocation thereof in the dimension D. The blank B is moved in the dimension D away from the conveyor belts 22 until the cuff C is a predetermined distance past the rail 68 which is mounted to the main frame of the machine 10 by levers 69, 70, as illustrated in FIG. 10. Then the cylinder 61 moves the projections 55 away from the projections 54, releasing the blank B, so that it drapes over the rail 68 in the manner illustrated in FIG. 1.

Utilizing the mechanism 19 it is possible to stack the finished blanks B more uniformly and with the cuff portions C thereof remaining flat, which facilitates subsequent operations (e.g. sewing of the blanks B into sleeves). Stacking over the rail 68 instead of on a flat table is also desirable since a shorter distance of travel of the block 66 under the influence of the pneumatic cable cylinder 71 is necessary. For instance, to drape the cloth blank B over a rail, the cylinder 71 need only have a travel of about 36 inches, whereas to lay it flat on a table it would need a travel of at least 48 inches.

The short sleeve stacking mechanism 20 may be utilized instead of the long sleeve stacker 19. The short sleeve stacker 20 includes (see FIGS. 12 and 13 in particular) a tray 75 mounted for rotation about shaft 76, shaft 76 extending in dimension A, and rotatable by a rotary air cylinder 77. The tray 75 includes a pair of side arms 78 which mount a plurality of rollers 79 on a rotatable shaft 80, the shaft 80 extending parallel to the shaft 76, and also being powered through any suitable drive mechanism (extending within an arm 78) by the motor 77.

Upon actuation of the motor 77, the entire tray 75 is rotated clockwise (as viewed in FIG. 12) so that the rollers 79 engage a finished blank B on top of the conveyor belts 22 and surface 21. The rollers 79 grip the blank B and move it onto the tray 75. Once the rotary cylinder 77 has been actuated for a predetermined length of travel and/or time, it cuts off, and any suitable spring mechanism—which has been tensioned or compressed by the clockwise rotation of the tray 75—causes the tray 75 to spring back to its initial position. This causes the garment blank B on the tray 75 to be flipped onto side table 82, into a stack. Once the desired number of flips of the tray 75 to form a stack of a desired height is counted by any suitable counting mechanism, the pusher 83—which is actuated by a pneumatic cylinder 90 (FIG. 14)—is operated to push the stack to the edge of the side table 82 so that a new stack may be formed on the portion of the side table 82 closest to the mechanism 20.

OPERATION

A plurality of sleeve blanks S are placed end to end on the second conveyor mechanism 12, with the edges 45 thereof to be sewn to cuff material C being at the right side of the second conveyor surface 12 (as seen in FIG. 1), and generally parallel to the direction A. The belts 22 run continuously and move the blanks S continuously forward in direction A. The electric eye 28 at the interface between the conveyors 11, 12, senses when a garment is beneath it, and when a garment is beneath it, it starts up the motor or motors for all of the equipment downstream, including the motor 26 for driving the belts 22, the motors 37, 38, and 52, the automatic sewing machine 17, and the solenoid 49. Once the sleeve blank S passes electric eye 28, the belts 24, rollers 14-16, etc. are temporarily stopped until another sleeve blank S moves under the eye 28. This procedure facilitates introduction of a small gap between the sleeve blanks S, while ensuring that production is at as high a rate as feasible.

At the same time that the sleeve blank S is being moved in direction A, cuffing material C is being withdrawn from the continuous roll A and folded over by the folding mechanism 33, passed through guide sleeve 34, and fed to roller 14. The cuff material C is disposed so that the double thickness edge 35 thereof overlaps and is in general alignment with the edge 45 of the sleeve blank S as both move into operative association with the over-edger automatic sewing machine 17. The motors 37, 38 are driven so that the roller 15 moves with essentially the same tangential velocity as the linear velocity of the belts 22, while the roller 14 is driven at a slower speed so that stretching of the cuff material C is effected between the rollers 14, 15.

After the cuff material C and sleeve blank S have been sewn together by the over-edger automatic sewing machine 17, and trimmed, they pass between the rollers 15, 16. Roller 16 operates at a significantly greater speed than roller 15, so that the cuff material C is again stretched to facilitate cutting thereof. The roller extension 52 engages the sleeve portion S of the cuffed blank being produced, and moves it quickly downstream. When the electric eye 50 senses that the sleeve S is no longer beneath it, it actuates the solenoid 49, or the like, which in turn actuates the blades 47, 48 of the cutting mechanism 18 to sever the cuff material C so that a distinct, discrete cuffed sleeve blank B (see FIG. 11) is produced.

Electric eye 50 also illustrates operation of control components associated with the pick-up head 19. For instance, through a timer 80 or the like, a solenoid controlled valve 81 is actuated so that air from the source 82 is fed through air jet 57 to separate the cuff C from the sleeve to allow grasping by the projections 54, 55. Similarly, timer 83 which controls solenoid operated valve 84 is actuated to cause the cylinder 61 to move the projections 54, 55 into gripping relationship, and once that has happened to in turn control the solenoid operated valve 85 associated with the reciprocating cable cylinder 71 to control linear movement of the mechanism 19. The finished blank B picked up thereby is moved in dimension D away from the conveyor belts 22 until it is draped over the rail 68, and then the cylinder 61 is controlled to release tha blank B, and the cylinder 71 controlled to return the projections 54, 55 to their original position.

When it is desirable to actuate the controls for the stacker 20 instead of the stacker 19, the switch 87 (see FIG. 14) is thrown to the position opposite that indicated in FIG. 14. Movement of a garment under the electric eye 50 causes actuation of the solenoid operated valve 88 which actuates the pneumatic rotary cylinder 77. After a predetermined count of the number of times that the motor 77 is actuated, the control 89 will allow fluid to pass to the cylinder 90, which in turn will actuate the pusher 83.

It will thus be seen that according to the present invention an effective, yet relatively simple, method and apparatus have been provided for the automatic cuffing or sportswear sleeves and the like. While the invention has been herein shown and described in what is presently conceived to be the most practical and preferred embodiment thereof, it will be apparent to those of ordinary skill in the art that many modifications may be made thereof within the scope of the invention. For instance, instead of providing the plurality of motors 26, 37, 38, and 52, a single motor may be provided (including for the sewing machine 17), variable speed pulley mechanisms taken off therefrom. Of course, a large variety of other modifications are also possible, so that the invention is to be accorded the broadest interpretation of the appended claims so as to encompass all equivalent methods and devices.

I claim:

1. A method of automatically cuffing sleeves, utilizing discrete sleeve blanks and a continuous roll of cuffing material, comprising the steps of:

(a) passing the sleeve blanks in a first direction, with a first edge thereof generally parallel to said first direction;

(b) automatically folding over the continuous length of cuffing material to provide a double thickness edge thereof, thereby defining a first edge;

(c) feeding said first edge of said sleeve blank and said first edge of said cuffing material so that they are in generally parallel overlapping relationship, and generally parallel to said first direction;

(d) automatically sewing said sleeve blank to said cuffing material adjacent said first edges thereof;

(e) automatically severing the cuffing material sewn to said sleeve blank from said continuous length of cuffing material, so as to form a distinct, discrete cuffed sleeve blank; and (f) automatically moving said cuffed sleeve blank in a second direction, generally perpendicular to said first direction to a distinct stacking area by directing an air jet between the cuff and the sleeve of said cuffed sleeve blank so as to provide spacing therebetween; automatically grasping said cuff, including moving a grasping member into the space created by the air jet between the cuff and the sleeve; and draping the cuffed sleeve blank over a rail so that the cuff thereof extends substantially flat, and cuffed sleeve blanks may be stacked so that the cuff portions thereof are uniformly disposed one atop the other.

2. A method of automatically cuffing sleeves, utilizing discrete sleeve blanks and a continuous roll of cuffing material, comprising the steps of:

(a) passing the sleeve blanks in a first direction, with a first edge thereof generally parallel to said first direction;

(b) automatically folding over the continuous length of cuffing material to provide a double thickness edge thereof, thereby defining a first edge;

(c) feeding said first edge of said sleeve blank and said first edge of said cuffing material so that they are in generally parallel overlapping relationship, and generally parallel to said first direction;

(d) automatically sewing said sleeve blank to said cuffing material adjacent said first edges thereof;

(e) automatically severing the cuffing material sewn to said sleeve blank from said continuous length of cuffing material, so as to form a distinct, discrete cuffed sleeve blank, wherein the cuffed sleeve blank formed is s short sleeve blank; and (f) automatically moving said cuffed sleeve blank in a second direction, generally perpendicular to said first direction to a distinct stacking area by engaging the blank with powered rollers rotatable about an axis generally parallel to said first direction, and flipping said blank, after engagement by the rollers, onto a flat stacking surface.

3. A method of automatically cuffing sleeves, utilizing discrete sleeve blanks and a continuous roll of cuffing material, comprising the steps of:

(a) passing the sleeve blanks in a first direction, with a first edge thereof generally parallel to said first direction by placing a plurality of sleeve blanks in substantially end-to-end position, with the first edges thereof generally aligned; and automatically introducing small gaps between said sleeve blanks prior to progressive movement of a sleeve blank into operative association with the cuffing material;

(b) automatically folding over the continuous length of cuffing material to provide a double thickness edge thereof, thereby defining a first edge;

(c) feeding said first edge of said sleeve blank and said first edge of said cuffing material so that they are in generally parallel overlapping relationship, and generally parallel to said first direction;

(d) automatically sewing said sleeve blank to said cuffing material adjacent said first edges thereof;

(e) automatically severing the cuffing material sewn to said sleeve blank from said continuous length of cuffing material, so as to form a distinct, discrete cuffed sleeve blank; and (f) automatically moving said cuffed sleeve blank to a distinct stacking area.

4. Apparatus for automatically cuffing sleeves comprising:

a substantially flat first conveyor surface;

a plurality of conveyor belts elongated in a first direction and having a portion thereof disposed atop said first conveyor surface, said belts spaced from each other in a second direction, substantially perpendicular to said first direction;

means for supporting a roll of cuffing material;

means for folding the cuffing material supplied from said roll so that said cuffing material is formed into a double thickness having a double thickness first edge thereof generally parallel to said conveyor belts;

a first driven roller mounted for operative cooperation with said first conveyor surface and said conveyor belts, said first roller rotatable about a first axis generally perpendicular to said first direction;

a second driven roller mounted for rotation about a second axis generally parallel to said first axis, and said second roller in operative association with said first conveyor surface and said conveyor belts, and spaced from said first roller in said first direction;

an automatic sewing machine operatively disposed between said first and second rollers;

a third driven roller rotatable about a third axis substantially parallel to said first and second axes, and disposed in operative relationship with said first conveyor surface and said conveyor belts, and spaced from said second roller in said first direction;

automatic cutting means disposed between said second and third rollers for cutting the continuous length of cuffing material;

automatic pick-up means for moving the formed cuffed sleeve blanks off said first conveyor surface, said pick-up means disposed downstream of said third roller in said first direction;

wherein each of said rollers comprises a plurality of rubber rings connected to a central shaft for rotation therewith, and spaced by a plurality of washers, said rubber rings each having an outside diameter greater than the outside diameter of said washers to that said rubber rings project radially outwardly from said central shaft farther than said washers; and wherein at least some of the washers associated with said second roller are loosely disposed about said central shaft so that said washers do not rotate with said shaft or said rubber rings; and wherein at least some of said washers of said second roller include a projecting portion thereof which extends outwardly beyond the circumferential periphery of said rubber rings and operatively engages said cutting means, to prevent material from passing behind said second roller and in front of said cutting means.

5. Apparatus as recited in claim 4 wherein said automatic cutting means comprises a scissors-type cutting mechanism operable by an electrically powered device activated by an electric eye positioned between said second and third rollers and at a position wherein it is not in operative association with cuffing material passing over said first conveying surface.

6. Apparatus as recited in claim 4 further comprising means for powering said first and second rollers at differential speeds for effecting stretching of cuffing material transported thereby.

7. Apparatus as recited in claim 4 further comprising means for powering said second and third rollers so that said third roller circumferential periphery has a greater tangential velocity than said second roller circumferential periphery, for effecting stretching of material engaged thereby.

8. Apparatus for automatically cuffing sleeves comprising:

a substantially flat first conveyor surface;

a plurality of conveyor belts elongated in a first direction and having a portion thereof disposed atop said first conveyor surface, said belts spaced from each other in a second direction, substantially perpendicular to said first direction;

means for supporting a roll of cuffing material;

means for folding the cuffing material supplied from said roll so that said cuffing material is formed into a double thickness having a double thickness first edge thereof generally parallell to said conveyor belts;

a first driven roller mounted for operative cooperation with said first conveyor surface and said conveyor belts, said first roller rotatable about a first axis generally perpendicular to said first direction;

a second driven roller mounted for rotation about a second axis generally parallel to said first axis, and said second roller in operative association with said first conveyor surface and said conveyor belts, and spaced from said first roller in said first direction;

an automatic sewing machine operatively disposed between said first and second rollers;

a third driven roller rotatable about a third axis substantially parallel to said first and second axes, and disposed in operative relationship with said first conveyor surface and said conveyor belts, and spaced from said second roller in said first direction;

automatic cutting means disposed between said second and third rollers for cutting the continuous length of cuffing material;

automatic pick-up means for moving the formed cuffed sleeve blanks off said first conveyor surface, said pick-up means disposed downstream of said third roller in said first direction; and wherein said third roller includes an extension having a larger diameter than the diameter of the rest of said roller, and rotatable about said axis of rotation, said extension adapted to engage sleeve blanks at portions thereof remote from the cuffing material.

9. Apparatus for automatically cuffing sleeves comprising:

a substantially flat first conveyor surface;

a plurality of conveyor belts elongated in a first direction and having a portion thereof disposed atop said first conveyor surface, said belts spaced from each other in a second direction, substantially perpendicular to said first direction;

means for supporting a roll of cuffing material;

means for folding the cuffing material supplied from said roll so that said cuffing material is formed into a double thickness having a double thickness first edge thereof generally parallel to said conveyor belts;

a first driven roller mounted for operative cooperation with said first conveyor surface and said conveyor belts, said first roller rotatable about a first axis generally perpendicular to said first direction;

a second driven roller mounted for rotation about a second axis generally parallel to said first axis, and said second roller in operative association with said first conveyor surface and said conveyor belts, and spaced from said first roller in said first direction;

an automatic sewing machine operatively disposed between said first and second rollers;

a third driven roller rotatable about a third axis substantially parallel to said first and second axes, and disposed in operative relationship with said first conveyor surface and said conveyor belts, and spaced from said second roller in said first direction;

automatic cutting means disposed between said second and third rollers for cutting the continuous length of cuffing material;

automatic pick-up means for moving the formed cuffed sleeve blanks off said first conveyor surface, said pick-up means disposed downstream of said third roller in said first direction; and a second conveyor surface and a second plurality of conveyor belts disposed in operative association therewith, said second plurality of conveyor belts interleaved with at least some of said plurality of conveyor belts elongated in the said first direction; and means for continuously powering said first plurality of conveyor belts, and for intermittently powering said second plurality of conveyor belts.

10. Apparatus for automatically cuffing sleeves comprising:

a substantially flat first conveyor surface;

a plurality of conveyor belts elongated in a first direction and having a portion thereof disposed atop said first conveyor surface, said belts spaced from each other in a second direction, substantially perpendicular to said first direction;

means for supporting a roll of cuffing material;

means for folding the cuffing material supplied from said roll so that said cuffing material is formed into a double thickness having a double thickness first edge thereof generally parallel to said conveyor belts;

a first driven roller mounted for operative cooperation with said first conveyor surface and said conveyor belts, said first roller rotatable about a first axis generally perpendicular to said first direction;

a second driven roller mounted for rotation about a second axis generally parallel to said first axis, and said second roller in operative association with said first conveyor surface and said conveyor belts, and spaced from said first roller in said first direction;

an automatic sewing machine operatively disposed between said first and second rollers;

a third driven roller rotatable about a third axis substantially parallel to said first and second axes, and disposed in operative relationship with said first conveyor surface and said conveyor belts, and spaced from said second roller in said first direction;

automatic cuffing means disposed between said second and third rollers for cutting the continuous length of cuffing material;

automatic pick-up means for moving the formed cuffed sleeve blanks off said first conveyor surface, said pick-up means disposed downstream of said third roller in said first direction; and wherein said finished cuffed sleeve blank moving means comprises a first projecting portion and a second projecting portion, said projecting portions mounted for rotation with respect to each other about an axis substantially parallel to said first direction; said first projection having means for directing an air jet therefrom to effect separation between the cuff portion and sleeve portion of a cuffed sleeve blank; and means for moving said axis of rotation of said first and second projections in a linear direction substantially perpendicular to the direction of elongation of said conveyor belts.

11. Apparatus as recited in claim 10 further comprising a freely accessible rail extending below and generally parallel to said conveyor belts, and linearly spaced from said conveyor belts in said second direction, and in operative association with said moving means.

12. A pick-up head for a discrete cuffed sleeve blank having a cuff portion and a sleeve portion that are sewn together, and disposed in overlapping relationship with said cuff portion laying atop said sleeve portion; said pick-up mechanism comprising:

a stationary apertured guard;

a first projection;

a second projection;

means for mounting said projections for relative rotational movement with respect to each other about an axis of rotation so that they are movable from a first position wherein they grasp the cuff portion of a cuffed sleeve blank therebetween, to a second position wherein they are spaced from each other;

an air jet associated with said first projection for directing a stream of air between the cuff and sleeve portions of a cuffed sleeve blank so as to allow said first projection to be inserted therebetween;

said second projection disposed along said axis of rotation and arranged such that it moves within an aperture formed in said guard; and means for moving said mounting means in a dimension generally parallel to the direction of said air jet.

13. A powering and cutting mechanism comprising:

a cutting mechanism including first and second blades movable with respect to each other to effect severing of flexible sheet material therebetween;

a powered roller rotatable about an axis of rotation, said roller located adjacent said first blade; and said roller comprising: a powered central shaft; a plurality of spaced rubber rings mounted on said shaft for rotation therewith, and spaced along said axis; a plurality of washers disposed between said rubber rings, said washers dimensioned so that the majority of the circumferential periphery thereof does not extend radially outwardly from said shaft as far as the circumferential periphery of said rubber rings, said washers mounted loosely on said shaft so that they do not rotate therewith; and a projecting portion on each of at least some of said washers, said projecting portion extending outwardly past the circumferential periphery of said rubber rings, and operatively engaging said first blade, and preventing flexible sheet material to be cut from moving between said roller and said first blade.

14. Apparatus for automatically cuffing sportswear sleeves, comprising:

a substantially flat first conveyor surface;

a plurality of conveyor belts elongated in a first direction and having a portion thereof disposed atop said first conveyor surface, said belts spaced from each other in a second direction, substantially perpendicular to said first direction;

means for supporting a roll of material;

a roller means mounted for operative cooperation with said first conveyor surface and said conveyor belts for maintaining material in operative association therewith;

an automatic sewing machine disposed in operative association with said roller means and said first conveyor surface;

a second conveyor surface and a second plurality of conveyor belts disposed in operative association therewith, said second plurality of conveyor belts interleaved with at least some of said first plurality of conveyor belts and elongated in the said first direction; and means for continuously powering said first plurality of conveyor belts, and for intermittently powering said second plurality of conveyor belts.

* * * * *